US005975369A

United States Patent [19]

Yurkewicz et al.

[11] Patent Number: 5,975,369

[45] Date of Patent: Nov. 2, 1999

[54] RESEALABLE PUSHABLE CONTAINER CLOSURE AND COVER THEREFOR

[75] Inventors: Michael A. Yurkewicz, Corry; Robert J. Smith, Edinboro, both of Pa.; Gregg S. Montgomery, West Chester, Ohio; Stephen Getsy, Erie, Pa.; David E. Babcock, Lafayette; Mike G. Palma, Carmel, both of Ind.; Lee Albrecht, Vyhalia, Mich.; Paul W. Robbins, Danville, Ind.

[73] Assignees: Erie County Plastics Corporation, Corry; Aluminum Company of America (ALCOA), Alcoa Center, both of Pa.

[21] Appl. No.: 08/869,501

[22] Filed: Jun. 5, 1997

[51] Int. Cl.[6] ..... B67D 5/33

[52] U.S. Cl. ..... 222/153.06; 222/525; 215/251; 220/257

[58] Field of Search ..... 220/257, 254, 220/203, 705; 215/901, 216, 251, 217, 252, 253, 331, 334, 387, 388, 389; 222/153.1, 525, 552, 524, 521, 153.06, 153.14, 541.5

[56] References Cited

U.S. PATENT DOCUMENTS

| | | | |
|---|---|---|---|
| 3,599,845 | 8/1971 | Miller | 222/525 |
| 3,743,127 | 7/1973 | Morceau | 215/217 X |
| 3,981,421 | 9/1976 | McDowell, Jr. et al. . | |
| 3,989,152 | 11/1976 | Julian | 215/217 X |
| 4,179,052 | 12/1979 | Abbott . | |
| 4,314,656 | 2/1982 | Kessler | 222/525 X |
| 4,383,623 | 5/1983 | Page, III | 222/525 X |
| 4,418,828 | 12/1983 | Wilde et al. . | |
| 4,497,765 | 2/1985 | Wilde et al. . | |
| 4,640,427 | 2/1987 | Marino et al. | 215/252 X |
| 4,726,483 | 2/1988 | Drozd | 215/252 |
| 4,746,035 | 5/1988 | Anderson et al. | 215/252 X |
| 4,817,831 | 4/1989 | Theisen | 222/525 X |
| 4,927,065 | 5/1990 | Beck . | |
| 4,946,080 | 8/1990 | Vesborg . | |
| 4,967,941 | 11/1990 | Beck . | |
| 4,993,570 | 2/1991 | Julian et al. | 215/252 |
| 5,022,562 | 6/1991 | Lurkis et al. | 222/525 X |
| 5,096,077 | 3/1992 | Odet et al. . | |
| 5,104,008 | 4/1992 | Crisci . | |
| 5,105,960 | 4/1992 | Crisci et al. | 215/252 X |
| 5,197,634 | 3/1993 | Beck | 222/549 X |
| 5,259,522 | 11/1993 | Morton . | |
| 5,265,777 | 11/1993 | Weistein . | |
| 5,328,063 | 7/1994 | Beck et al. . | |
| 5,429,255 | 7/1995 | Glynn . | |
| 5,456,374 | 10/1995 | Beck | 215/252 X |
| 5,465,876 | 11/1995 | Crisci | 222/153.1 |
| 5,472,120 | 12/1995 | Stebick et al. | 222/525 X |
| 5,562,219 | 10/1996 | De Pous et al. | 222/153.1 X |
| 5,662,247 | 9/1997 | Rapchak et al. | 222/153.1 X |
| 5,810,185 | 9/1998 | Groesbeck | 222/525 X |

*Primary Examiner*—Stephen K. Cronin
*Assistant Examiner*—Nathan Newhouse
*Attorney, Agent, or Firm*—Webb Ziesenheim Logsdon Orkin & Hanson, P.C.

[57] ABSTRACT

A container closure includes a shell attachable to a container around a container opening thereof. The shell has a shell opening in fluid communication with the container opening when the shell is attached to the container. A tip is received on the shell movable between a closed position sealing the shell opening and an open position. A cover is releasably attached to the shell in a manner indicative of the tip being positioned in the closed position when the cover is attached to the shell. Both the shell and the cover may be provided with tamper-evident bands. The present invention is particularly well adapted to be formed as a push-pull container closure for sports bottles and the like.

19 Claims, 11 Drawing Sheets

RESEALABLE PUSHABLE CONTAINER CLOSURE AND COVER THEREFOR

BACKGROUND OF THE INVENTION

1. Field of the Invention

The present invention relates to container closures, more specifically the present invention relates to push-pull type container closures for sports water bottles and the like.

2. Prior Art

The prior art discloses a wide variety of push-pull type container closures. Representative samples are found in U.S. Pat. Nos. 5,104,008; 5,265,777; 5,096,077; and 5,429,255. Additionally, the prior art discloses a wide variety of closures incorporating tamper-evident bands. Examples of appropriate tamper-evident bands can be found in U.S. Pat. Nos. 5,259,522; 4,418,828; and 4,497,765. However, the prior art does not provide a push-pull type container closure with an effective tamper-evident band in meaningful locations on the push-pull type container. Furthermore, many of the push-pull type container closures of the prior art are difficult to manufacture and do not effectively guarantee complete resealing of the closure during operation. For example, one common type of push-pull closure is referred to as a sports top. Many existing sports tops use a "shrink" or "cello" sleeve to additionally be applied for the purpose of tamper evidence. This causes additional cost, added capital, and decreasing operating efficiencies.

SUMMARY OF THE INVENTION

The object of the present invention is to overcome the drawbacks of the prior art and to provide an easily manufactured container closure which provides a reliable sealing condition.

The objects of the present invention are achieved by providing a container closure which includes a shell adapted to be attached to a container around a container opening thereof with the shell having a shell opening adapted to be in fluid communication with the container opening when the shell is attached to the container. A tip is received on the shell movable between a closed position sealing the shell opening and an open position. A cover is releasably attached to the shell and the cover is indicative of the tip being positioned in the closed position when the cover is attached to the shell.

The cover may include a tamper-evident band on a lower portion thereof. The cover may include a top, a cylindrical side extending down from the top, wherein the tamper-evident band is formed by a lower portion of the side below a score line. The side above the score line may be flexed inwardly to break off the tamper-evident band at the score line. Alternatively, the cover of the present invention may provide a device to prevent relative rotation of the tamper-evident band in one or both directions. With the rotation prevention device, continued rotation of the cover will break off the tamper-evident band along the score line. The shell may also be provided with a tamper-evident band at a lower portion thereof.

The tip may be slidably received on the shell with the shell including a central stem and the shell opening formed as an annular opening surrounding the stem. The shell may further include an annular wall surrounding and spaced from the annular opening. The tip may include an inner and outer sleeve member both positioned adjacent the annular wall and including at least one ring-sealing member extending from the sleeve member and in sliding engagement with the annular wall. It may further include a tip opening in fluid communication with the shell opening when the tip is in the open position and an annular stem-sealing member surrounding the tip opening with the stem-sealing member in sealing engagement with the stem when the tip is in the closed position.

The cover may include a connecting flange coupled to the top of the cover which is releasably engageable with a groove of the stem to releasably attach the cover to the shell.

These and other advantages of the present invention will be clarified in the description of the preferred embodiment taken together with the attached figures wherein like references will represent like characters throughout.

BRIEF DESCRIPTION OF THE PREFERRED EMBODIMENTS

Figure 1:
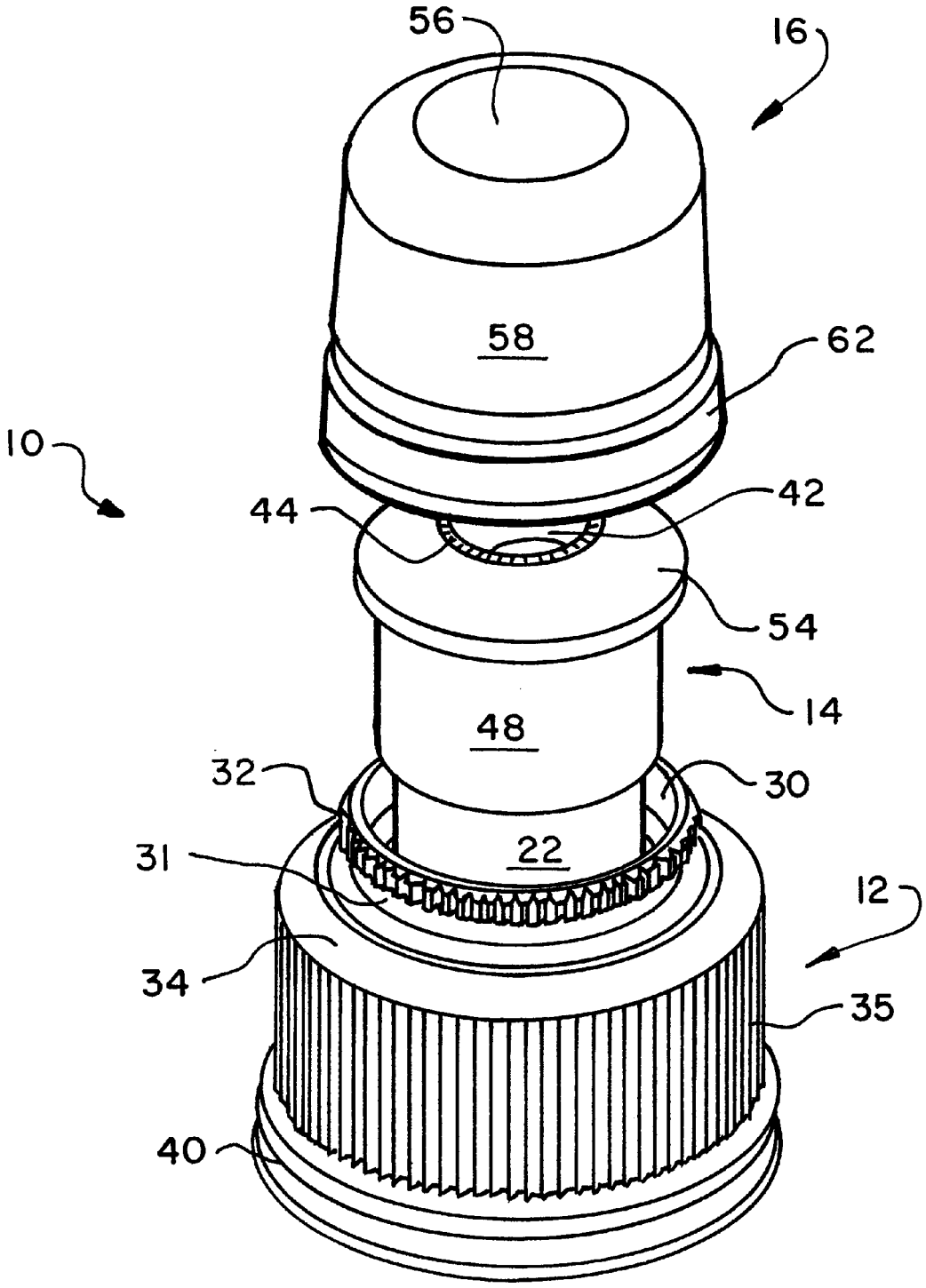
FIG. 1 is a partially exploded perspective view of a container closure according to a first embodiment of the present invention.

FIG. 1 illustrates a container closure 10 according to the present invention. The container closure 10 includes a shell 12 that is adapted to attach to a container (around a container opening thereof). A tip 14, is slidably received on the shell 12 and moveable between a closed position and an open position as will be described hereinafter. A dust cover 16 is releasably attached to the shell 12, with the cover 16 indicative of the tip 14 being positioned in the closed position when the cover 16 is attached to the shell 12.

Figure 3:
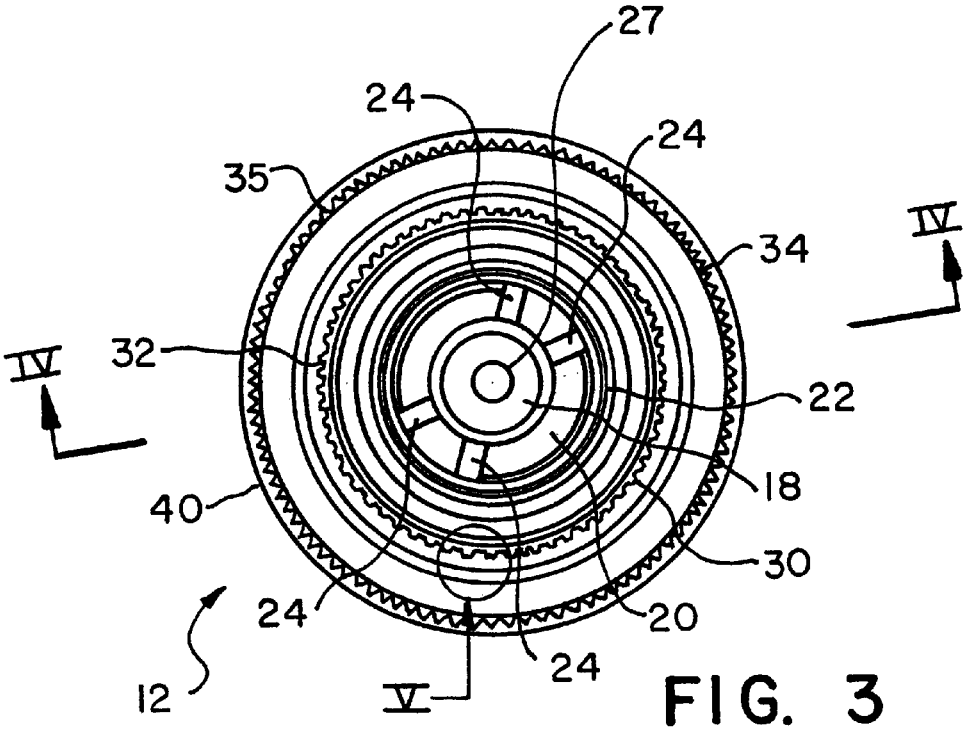
FIG. 3 is a plan view of a shell of the container closure illustrated in FIG. 1.
Figure 4:
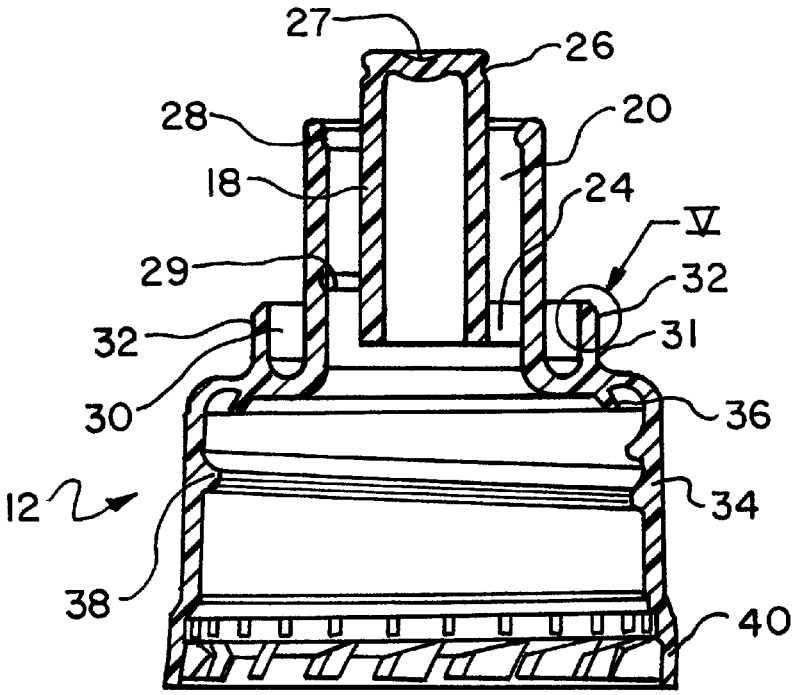
FIG. 4; is a cross-sectional view of the shell illustrated in FIG. 3 taken along line IV—IV.

The configuration of the shell 12 can be more easily reviewed in connection with FIGS. 3 and 4. The shell 12 includes a central stem 18 surrounded by an annular opening 20. The annular opening 20 is adapted to be in fluid communication with the container opening when the shell 12 is attached to the container. An annular wall 22 surrounds the annular opening 20 and is spaced from the stem 18 by a plurality of bridging elements 24. As shown in FIG. 3, the bridging elements 24 are arranged in two sets of diametrically opposed pairs, the first set of bridging elements 24 being spaced from the second set of bridging elements 24 by about 50°.

The stem 18 includes a cover-attaching member in the form of a groove 26 around an upper portion of the stem 18.

The groove 26 serves to releasably attach the cover 16 as will be described hereinafter. As shown in FIG. 4, the annular wall 22 does not extend to the full height of the stem 18. This will facilitate the manufacturing of the shell 12. The diameter of the stem 18 is slightly smaller above the groove 26 than below the groove 26. The function of the smaller diameter of the stem 18 will be described in connection with the tip 14. A gate well 27 is provided at the top of the stem 18. The gate well 27 prevents flashing created during the injection molding process from extending above the top surface of the stem 18, protecting the user against sharp corners and the like.

The top of the annular wall 22 includes a pair of radially inwardly extending stops 28. Each stop 28 is engagable with the tip 14 to stop the upwardly sliding movement of the tip 14 in the open position (shown in FIG. 2) as will be described hereinafter. A greater number of stops 28 may also be provided. The annular wall 22 includes two undercuts 29 each extending approximately 130° around the inner portion of the annular wall 22. The undercuts 29 cooperate with the tip 14 to create an audible click in the closed position as will be described below.

Figure 5A:
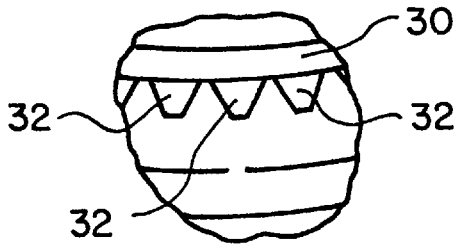
FIGS. 5*a* and *b* are enlarged plan and sectional views of a portion of the shell illustrated in FIGS. 3–4.
Figure 5B:
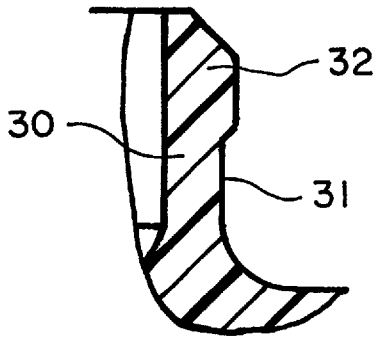

The shell 12 includes an upwardly extending annular ring 30 surrounding and radially spaced from the annular wall 22 as shown in FIG. 4. The spacing of the ring 30 from the annular wall 22 effects the manufacturing of the shell 12. During molding, of the shell 12 a sleeve is positioned between the ring 30 and annular wall 22. Retraction of the sleeve creates the space between the ring 30 and the annular wall 22 which permits the inwardly flexing of the ring 30 during extraction from the mold. As shown in FIG. 4, the annular wall 22 extends higher than the ring 30. The ring 30 includes an undercut 31 positioned below a plurality of outwardly extending projections 32 formed at the upper end 30. The projections 32 are shown in detail in FIGS. 5*a* and *b* and essentially form a ridge around the top of the ring 30. The projections 32 at least initially attach the cover 16 to the shell 12. The projections 32 also form a rotation-stopping mechanism relative to a portion of the dust cover 16 as will be described in connection with the dust cover 16.

The shell 12 includes a substantially cylindrical body 34 extending from the annular wall 22. As shown in FIG. 1 a plurality of vertically extending gripping ribs 35 can be positioned on the outer cylindrical portion of the body 34 to assist in the rotation of the shell 12. A plurality of vertically extending gripping ribs 35 can be positioned on the cylindrical portion of the body 34 to assist in the rotation of the shell 12. A sealing ring 36 is attached to an inner surface of the cylindrical body 34 surrounding the annular opening 20. The sealing ring 36 is adapted to seal against the container around the container opening when the shell 12 is attached to the container. Threads 38 are formed on an inner cylindrical portion of the body 34 of the shell 12. The threads 38 are intended to cooperate with corresponding threads of the container for attaching the shell 12 to the container. A tamper-evident band 40 extends down from the cylindrical portion of the body 34. The tamper-evident band 40 may be formed in a conventional fashion such as described in U.S. Pat. Nos. 4,497,765 or 4,418,828. Specifically, the tamper-evident band 40 may include a plurality of leaders or ribs, a score line through the leaders, and a plurality of wings.

Figure 2:
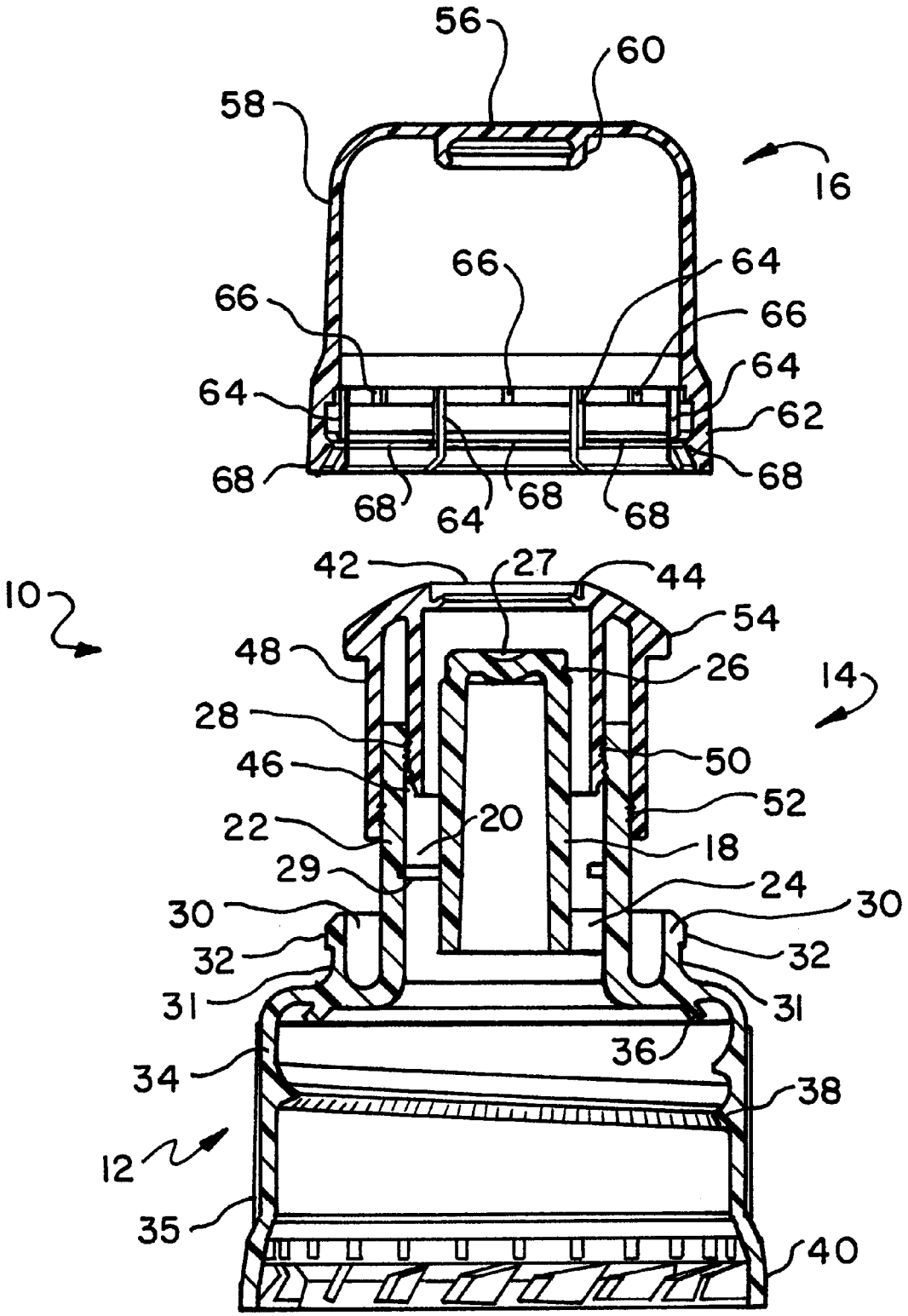
FIG. 2 is a partially exploded sectional view of the container closure illustrated in FIG. 1.
Figure 6:
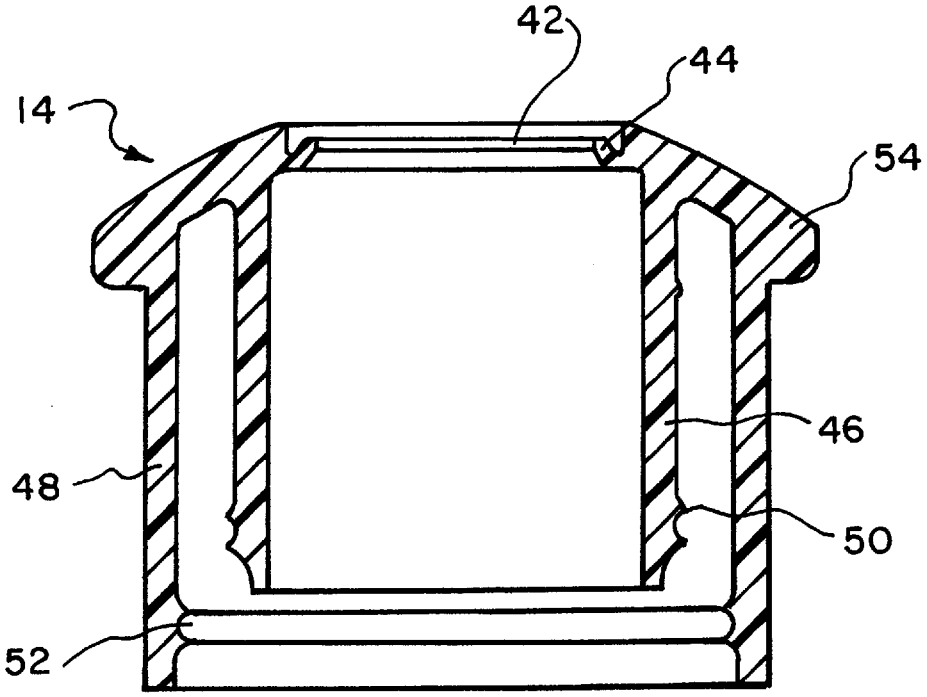
FIG. 6 is a cross-sectional view of a tip of the container closure illustrated in FIG. 1.

The tip 14 is slidably positioned on the shell 12 between an open and a closed position. The tip 14 is shown in greater detail in FIG. 6. The tip 14 includes a tip opening 42 which is adapted to be in fluid communication with the annular opening 20 of the shell 12 when the tip 14 is in the open position generally shown in FIG. 2. The tip opening 42 is surrounded by a stem-sealing member 44 which is adapted to engage with the sides of the stem 18 below the groove 26 to seal the tip opening 42 when tip 14 is in the closed position. As noted above, the diameter of the stem 18 above the groove 26 is smaller than the sealing portion of the stem below the groove 26. This construction avoids the "snap" of the stem-sealing member 44 being received into the groove 26 which the user could misinterperate as sealing of the closure 10. The stem-sealing member 44 preferably seals below the groove 26. The stem sealing member 44 has a diameter slightly smaller than the sealing portion of the stem 18 below the groove 26 and the stem-sealing member 44 is adapted to flex outwardly slightly. This construction ensures a good seal between the stem sealing member 44 and the stem 18. The tip 14 includes a sleeve member extending down from the stem sealing member 44 including an inner sleeve 46 and an outer sleeve 48. The inner sleeve 46 includes a projection formed by a radially outwardly extending annular bead 50 and the outer sleeve 48 includes a radially inwardly extending annular seal 52. The annular bead 50 and seal 52 are positionally spaced from one another (i.e. the annular bead 50 and seal 52 are not directly opposed from each other). The non-alignment, or offsetting of the annular bead 50 and seal 52 improves manufacturability of the tip 14. If the annular bead 50 and seal 52 were aligned a molding insert with a very narrow web between the opposed bead 50 and seal 52 would have to be used increasing the difficulties in manufacturing. The present design avoids these difficulties. The inner sleeve 46 and outer sleeve 48 are adapted to be positioned on opposite sides of the annular wall 22 with both the annular bead 50 and seal 52 in sliding, sealing engagement with the annular wall 22. If desired the bead 50 may be sized to also move in a sliding sealing engagement with the annular wall 22 to form a seal. The bead 50 of the tip 14 slides over the undercuts 29 of the shell 12 to produce an audible and tangible click as the tip 14 is moved to the closed position. The audible and tangible click indicates to the user the closed position. In the uppermost position of the tip 14, the annular bead 50 of the inner sleeve 46 will abut against the stops 28 to limit the upward movement of the tip 14 relative to the shell 12. This position, shown in FIG. 2 is the open position of the tip 14. In the open position of the tip 14, the stem sealing member 44 is positioned above the stem member 18 such that the tip opening 42 is in fluid communication with the annular opening 20 for dispensing the contents of the container through the container opening. The tip 14 additionally includes a grippable ledge 54 extending radially outwardly from an upper portion of the sleeve member to allow for easy grasping and movement of the tip 14 between the up, open position and the down, closed position.

Figure 7A:
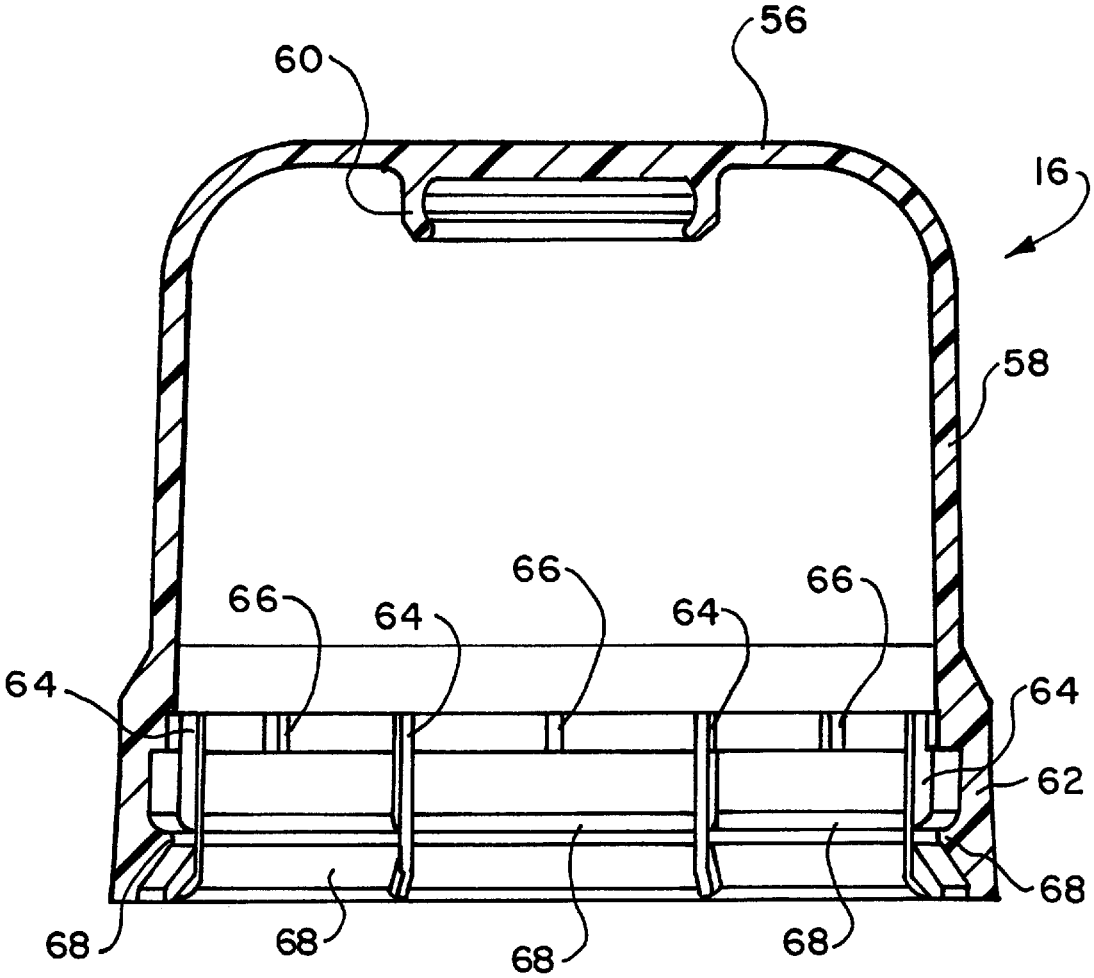
FIG. 7*a* is a cross-sectional view of the dust cover of the container closure illustrated in FIG. 1.
Figure 7B:
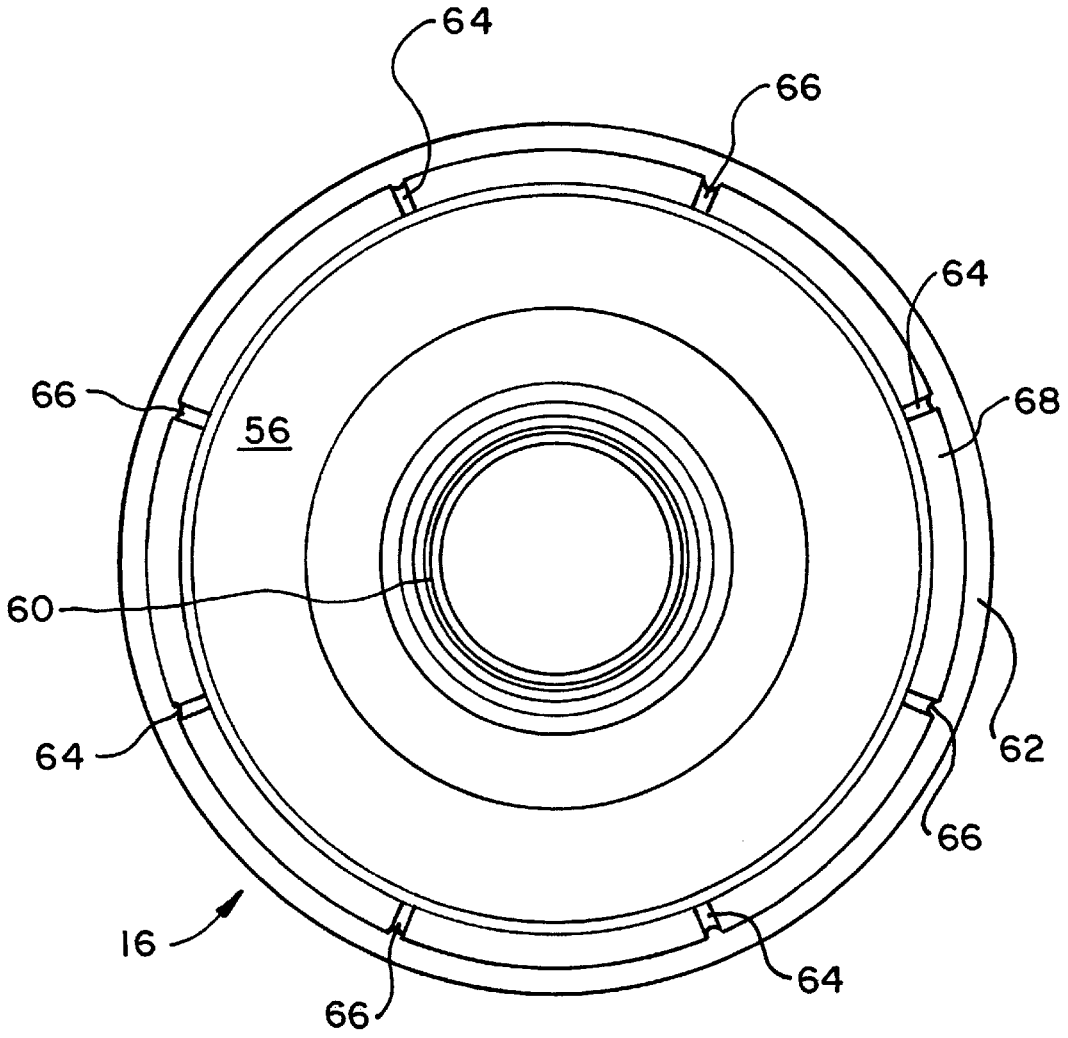
FIG. 7*b* is a bottom plan view of the dust cover illustrated in FIG. 7*a;*
Figure 8:
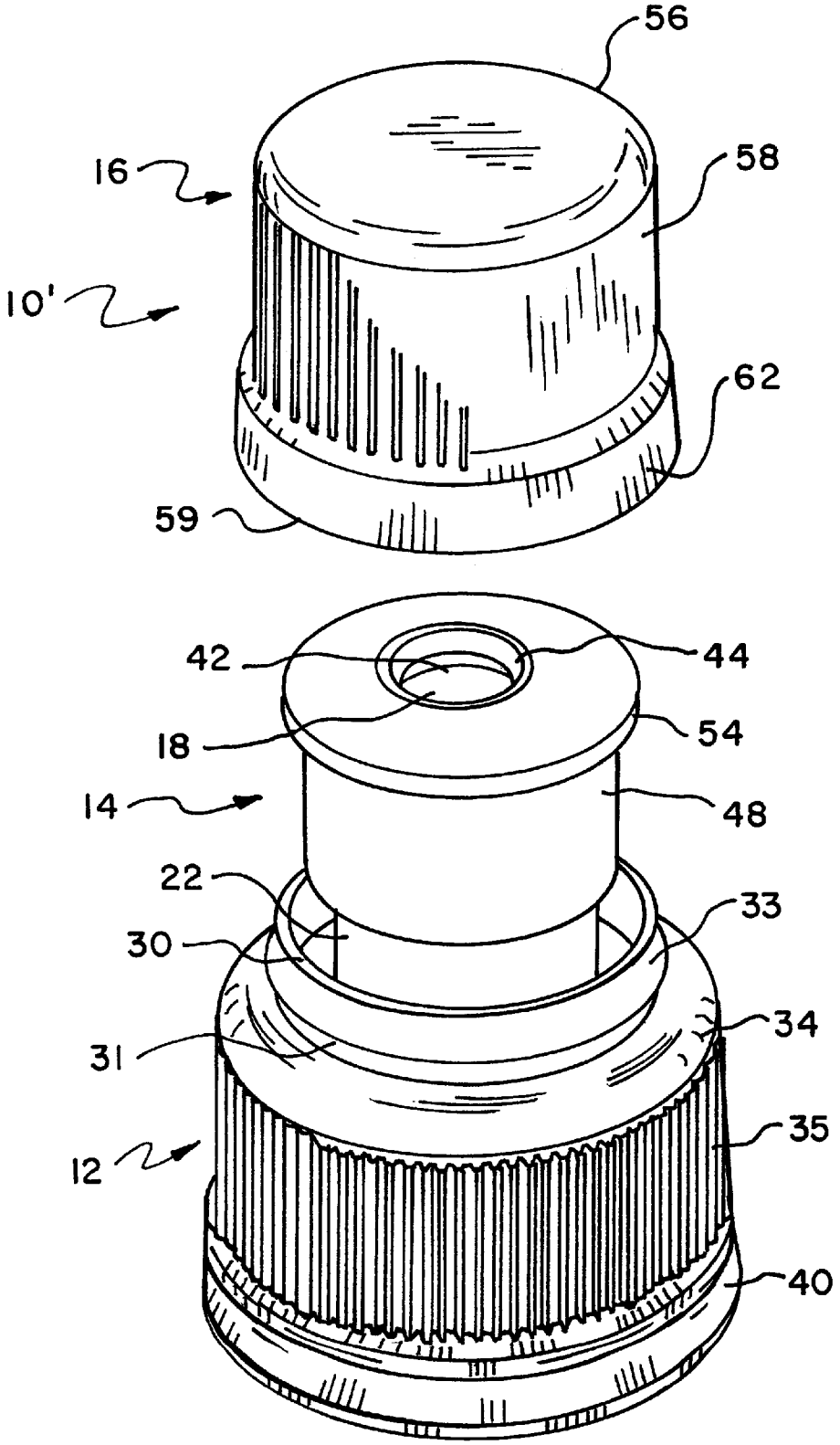
FIG. 8 is a partially exploded perspective view of a container closure according to, a second embodiment of the present invention.
Figure 10:
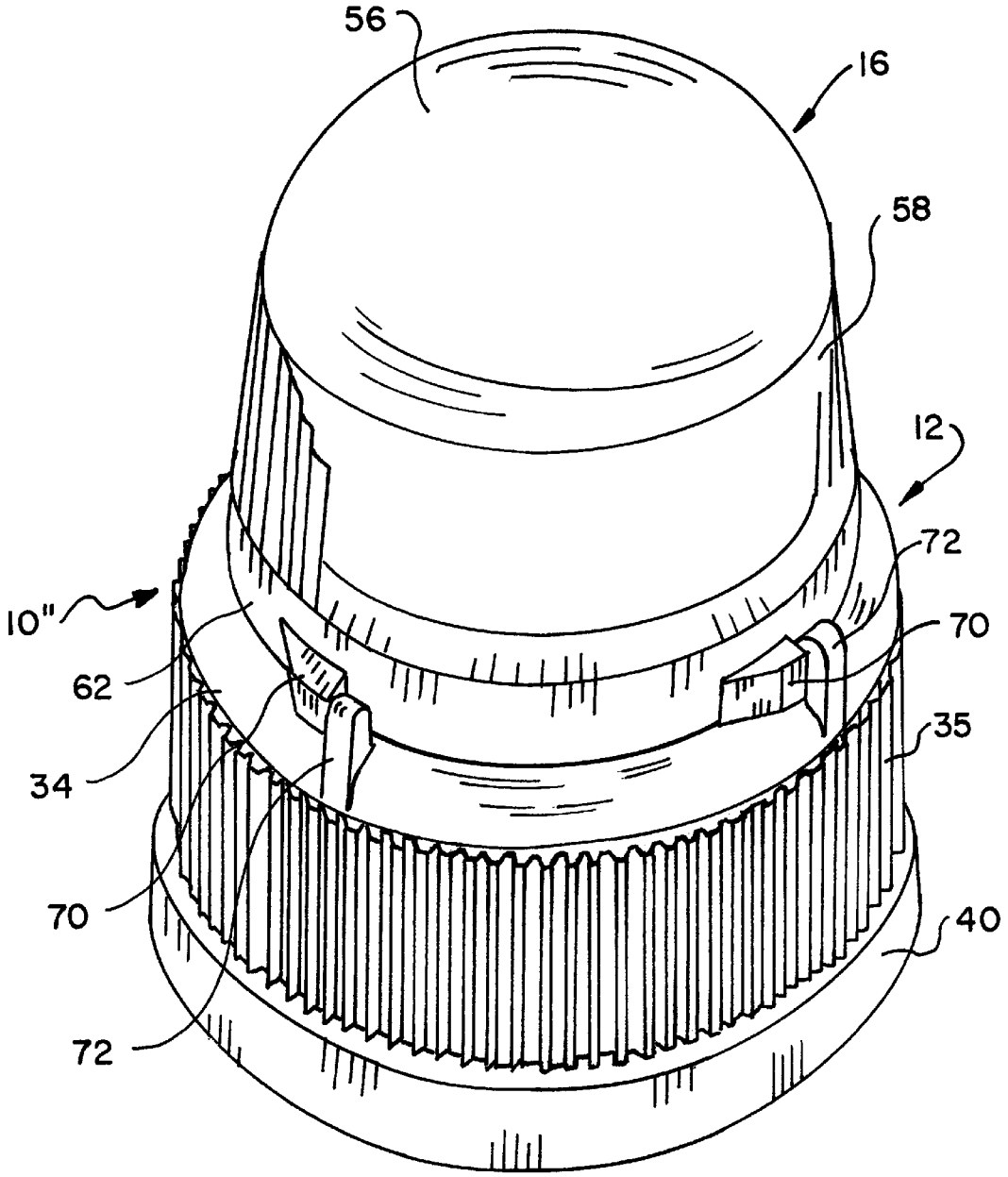
FIG. 10 is a perspective view of a container closure according to a third embodiment of the present inventor.

The dust cover 16 is illustrated in detail in FIGS. 7*a* and *b*. The cover 16 includes a top 56 with a cylindrical side 58 extending down from the top 56. A plurality of gripping ribs 59 may be provided on the outer portion of the cylindrical side 58 to provide for easy gripping of the cover 16 as shown in FIGS. 8 and 10. An annular connecting flange 60 is attached to and extends downwardly from the inner surface of the top 56. The connecting flange 60 is adapted to snap into the groove 26 of the stem 18 to releasably attach the cover 16 to the shell 12. With this configuration, it can be assured that when the connecting flange 60 is engaged with the groove 26 of the stem 18, the tip opening 42 and stem-sealing member 44 for the tip 14 will be positioned below the groove 26 such that the stem-sealing member 44 is sealed against the stem 18. This configuration assures that when the cover 16 is re-attached to the shell 12 (i.e. after use), the tip 14 is positioned in the closed position. The bottom of the connecting flange 60 includes a chamfered or tapered portion which assists in manufacturing.

A tamper-evident band 62 is formed as a lowermost portion of the cylindrical side 58 below a score line (not shown). A plurality of long leaders 64 and standard leaders 66 are provided extending across the score line for the construction of tamper-evident band 62. The leaders 64 and 66 form a frangible connection between the tamper evident band 62 and the lowermost portion of the cylindrical side 58. The long leaders 64 will extend, below the score line, between adjacent projections 32 and combine to serve as a rotation prevention mechanism preventing relative rotation between the tamper evident band 62 and the shell 12. Additionally, a plurality of radially inwardly extending ramp-shaped projections 68 are positioned on the inner cylindrical side 58 below the score line to be part of the tamper-evident band 62. The projections 68 are received in the undercut 31 below the projection 32 of the annular ring 30 to initially attach the cover 16 to the shell 12. Before the tamper evident band 62 is separated from the dust cover 16 (i.e. before the first consumer use) the projection 68 attach the dust cover 16 to the shell 12. After the tamper evident band 62 is separated from the dust cover 16 the connecting flange 60 and groove 26 is used to attach the dust cover 16 to the shell 12. The projections 68 will help retain the severed tamper-evident band 62 on the closure 10.

The container closure 10 will generally operate as follows. The container closure 10 will be assembled by the manufacturer as illustrated in FIG. 1 and subsequently attached to an appropriate container, such as a sports-drink bottle, i.e. water bottle, juice bottle, or the like. The container closure 10 will be attached to the container by threading the shell 12 onto an appropriately threaded closure by use of threads 38. The inclusion of both tamper-evident bands 40 and 62 will provide the necessary level of security to the user. The container may, contain an optional thin foil protective covering, covering the container opening which must be removed prior to use. On purchasing the product, the user can remove the shell 12 from the container by unthreading of the shell 12 which will break away the tamper-evident band 40 in the known manner. The user then will remove the thin foil (if provided) covering the container opening and replace the shell 12. To access the tip 14, the user will need to remove the cover 16 from the shell 12 which requires the separation of the tamper-evident band 62 from the cover 16. The tamper-evident band 62 can be separated from the remaining portions of the cylindrical side 58 by inwardly flexing of the cylindrical side 58 above the score line. The spacing of the annular ring 30 from the annular wall 22 allows for the inward flexing of the cylindrical side 58 above the score line for breaking of the tamper-evident band 62. Alternatively, the tamper-evident band 62 may be removed from the dust cover 16 by twisting of the upper portion of the dust cover 16 relative to the shell 12. During twisting of the dust cover 16 the interengagement of the long leaders 64 and the projections 32 will prevent the tamper-evident band 62 from rotating, allowing the leaders 64 and 66 to be broken at the score line to sever the tamper-evident band 62. The receipt of projections 68 in undercut 31 below the projections 32 of the ring 30 will maintain the tamper-evident band 62 on the ring 30 as the cover 16 is removed from the shell 12 as illustrated in FIG. 3. With the cover 16 removed from the shell 12, the tip 14 can be moved to the open position and the material dispensed from the container. The container is easily resealed by sliding the tip 14 to the closed position where the stem-sealing member 44 engages the stem 18 below the groove 26 to seal the tip opening 42. The replacement of the cover 16 on the shell 12 may indicate the movement of the tip 14 to the closed position by the engagement of the connecting flange 60 in the groove 26 as described above. Consequently the cover 16 may be indicative of the tip 14 being in the closed position when the cover 16 is attached to the shell 12.

Where the provision of a second tamper-evident band 62 on the cover 16 is not desired, the score line can be eliminated effectively preventing the formation of the tamper-evident band 62. With this configuration, the projections 68 could cooperate with the projections 32 of the annular ring 30 to form a permanent second attaching mechanism for releasably attaching the cover 16 to the shell 12. As discussed above, the connecting flange 60 and groove 26 will form the first cover-attaching mechanism. This configuration of cover 16 should be designed with suitably flexible plastic so that the projection 68 can easily slip over the projections 32. Additionally, this design requires a dimensioning of the dust cover 16 such that the connecting flange 60 is received in the groove 26 at the same time as the projections 68 are received in the undercut 31. Without tamper-evident band 62 the leaders 64 and 66 need not be provided.

Figure 9A:
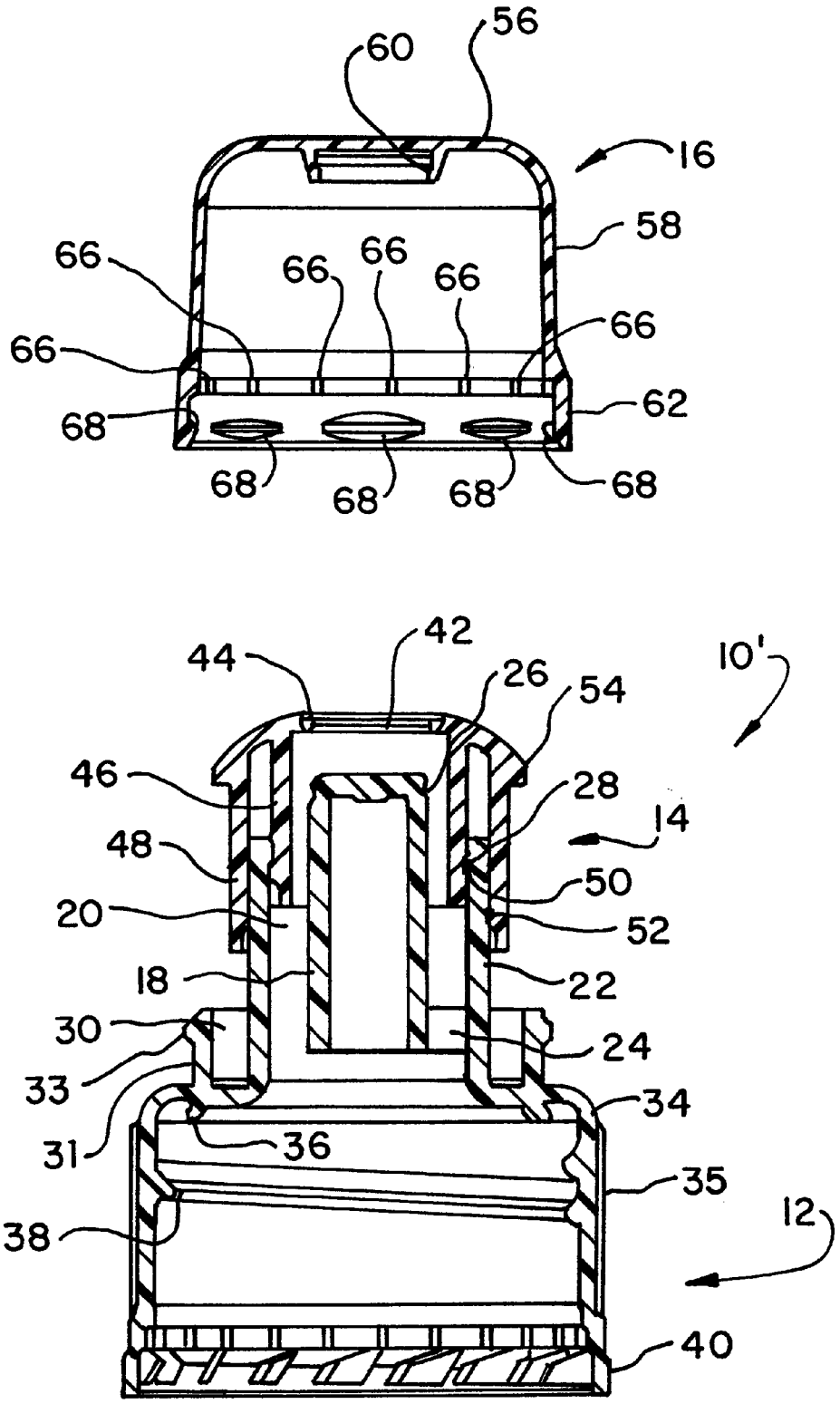
FIGS. 9–*c* are sectional views of the container closure illustrated in FIG. 8.
Figure 9B:
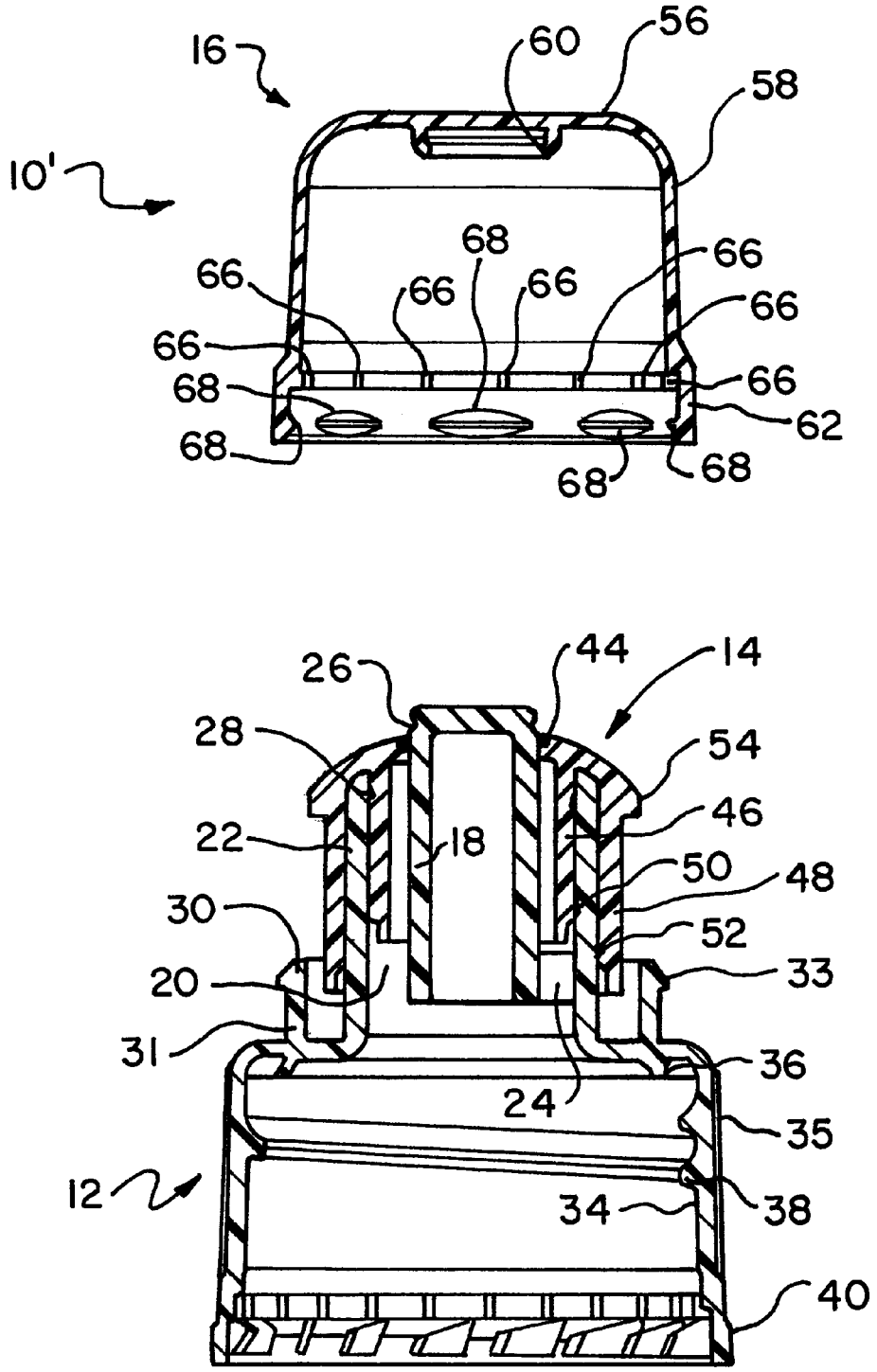
Figure 9C:
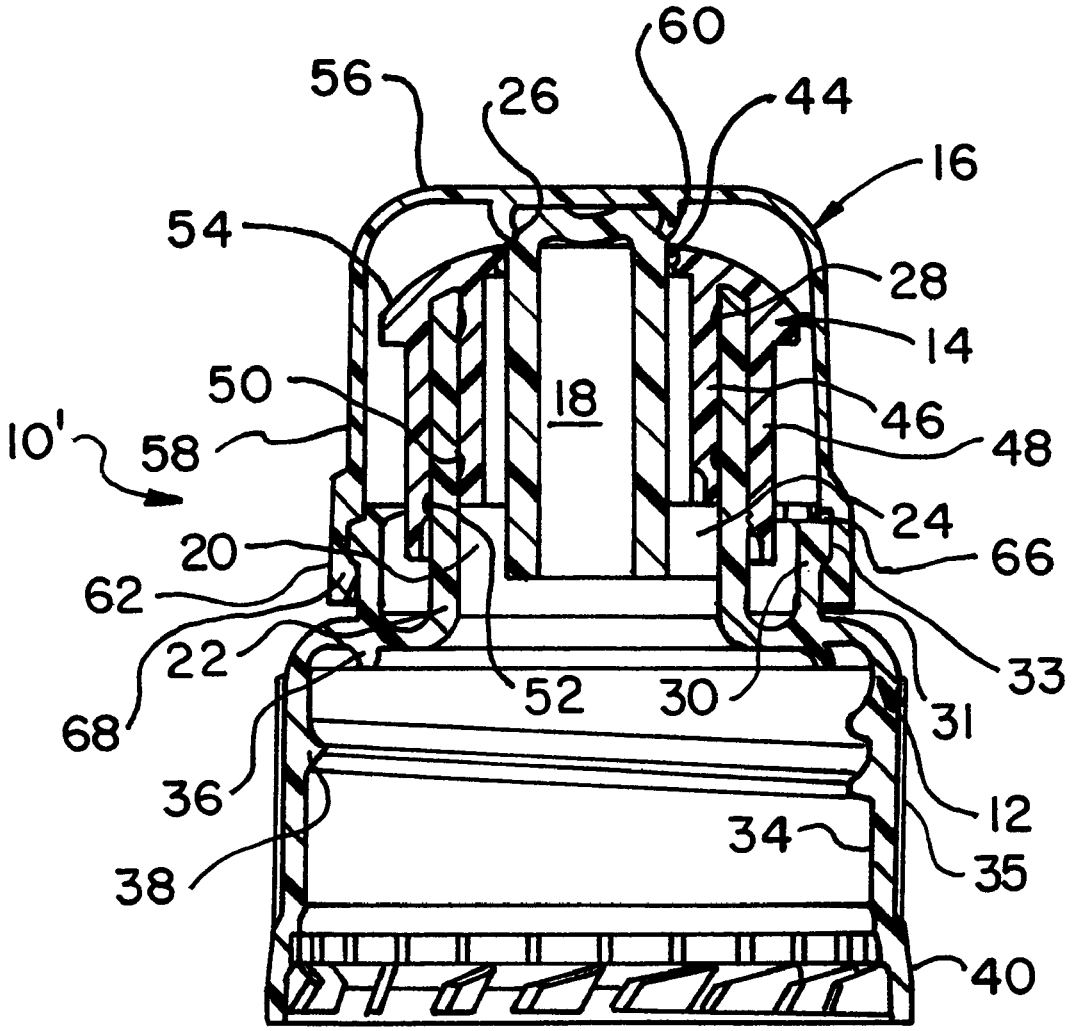

FIG. 8 illustrates a container closure 10' according to a second embodiment of the present invention. The container closure 10' is substantially the same as the container closure 10 illustrated in FIGS. 1–7*b*. The container closure 10' does not include a rotation-preventative mechanism for the tamper-evident band. As shown in FIGS. 9*a*–9*c* only standard leaders 66 attach the tamper-evident band 62 to the remainder of the side 58, the long leaders 64 have been replaced with standard leaders 66. Additionally, the plurality of projections 32 is replaced with a continuous ridge 33. The plurality of projections 68 are received in the undercut 31 below the ridge 33. The provision of a plurality of projections 68 instead of a continuous bead allows the dust cover to more easily snap onto the ring 30 by reducing hoop stresses which would otherwise be present. The ramp-type structure of the lower side of the projections 68 also assist in the placement of the dust cover 16 on the shell 12. Without the rotation-preventative mechanism the side 58 of the dust cover 16 is inwardly flexed to remove the tamper-evident band 62. FIGS. 9*a*–9*c* illustrate the operative positions of the container closure 10' including the simultaneous use of both the connecting flange 60 and the projections 68 to attach the dust cover 16 to the shell 12. If the tamper-evident band 62 is used (i.e. if a score line is provided partially through the leaders 66) then only the connecting flange 60 will be used for the attachment of the dust cover 16 subsequent to removal of the tamper-evident band 62. As shown in FIG. 8 a plurality of gripping ribs 59 are provided on the outer portion of the cylindrical side 58 to provide for easy gripping of the cover 16. The ribs 59 may be used with the dust cover 16 of any embodiment of the present invention.

FIG. 10 illustrates a container closure 10" according to a third embodiment of the present invention. The modified container closure 10" is substantially the same as the container closures 10 and 10" illustrated in FIGS. 1–9*c*. The container closure 10" includes the ridge 33 with all standard leaders 66 as described in connection with container closure 10'.

The container closure 10" includes a separate rotation stopping mechanism to assist in the removal of the tamper-evident band 62 of the cover 16. In the container closure 10" a plurality of outwardly extending ears 70 are positioned on the cylindrical side 58 of the dust cover 16 below the score line to be part of the tamper-evident band 62. The shell 12 includes a plurality of upwardly extending stop members 72 positioned outside of the ring 30 engageable with the ear 70 to prevent rotation of the tamper-evident band 62. The ear 70 and stop member 72 cooperate to assist in the removal of the cover 16 by preventing rotation of the tamper-evident band 62. Twisting of the cylindrical side 58 by grasping of the gripping ribs 59 can be utilized for breaking the tamper-evident band 62 in addition to flexing of the cylindrical side 58 above the score line similar to the container closure 10. The addition of the ears 70 and the stop member 72 allows the cover 16 to be made out of relatively harder plastics for a wider variety of applications.

It will be appreciated by those of ordinary skill in the art that various modifications may be made to the present invention without departing from the spirit and scope thereof. Consequently, the scope of the present invention is intended to be defined by the appended claims.

What is claimed is:

1. A container closure comprising:

a shell having a body attachable to a container around a container opening thereof, said shell having a shell opening in fluid communication with the container opening when said shell is attached to the container, wherein said shell includes a central stem, said shell opening is an annular opening surrounding said stem, an annular wall extending from said body and surrounding said annular opening, said stem attached to said annular wall, and a cover attaching member positioned on said stem;

a tip received on said shell movable between a closed position sealing said shell opening and an open position; and a cover releasably attached to said shell, wherein said cover attaching member of said shell engages said cover to releasably attach said cover to said shell, said cover indicative of said tip being positioned in said closed position when said cover is attached to said shell.

2. The container closure of claim 1 wherein said cover-attaching member is formed by a groove on said stem, said groove engaging said cover to releasably attach said cover to said shell.

3. The container closure of claim 1 wherein said shell further includes an annular ring extending from said body said annular ring surrounding and spaced from said annular wall, and at least one projection extending radially outwardly on said annular ring.

4. The container closure of claim 1 wherein said tip is slidably received on said shell and said tip includes at least one sleeve member positioned adjacent said annular wall and at least one ring-sealing member extending from said sleeve member and in sliding engagement with said annular wall.

5. The container closure of claim 1 wherein said tip includes a tip opening in fluid communication with said shell opening when said tip is in said open position, and an annular stem-sealing member surrounding said tip opening, said stem-sealing member in sealing engagement with said stem when said tip is in said closed position.

6. The container closure of claim 1 wherein said cover includes a tamper-evident band removably attached to said cover.

7. The container closure of claim 6 wherein said cover further includes a top, a cylindrical side wall extending from said top, wherein said tamper-evident band is formed by a lower portion of said cylindrical side wall and at least one projection extending radially inwardly of said side wall.

8. The container closure of claim 6 wherein said cover further includes a top, a cylindrical side wall extending from said top, wherein said tamper-evident band is formed by a lower portion of said cylindrical side wall and at least one radially extending ear on the outer surface of said cylindrical side wall, said shell further including at least one outer stop member engageable with said radially extending ear.

9. A container closure comprising:

a shell having a body attachable to a container around a container opening thereof, said shell having a shell opening in fluid communication with the container opening when said shell is attached to the container, said shell including a central stem, said shell opening is an annular opening surrounding said stem, an annular wall extending from said body surrounding said annular opening, wherein said stem is attached to said annular wall, and wherein said shell further includes at least one stop extending radially from said annular wall;

a tip received on said shell movable between a closed positioned sealing said shell opening and an open position, wherein said tip is slidably received on said shell and said tip includes at least one sleeve member positioned adjacent said annular wall and at least one ring sealing member extending from said sleeve member in a sliding engagement with said annular wall and said stop of said shell abutting against a projection on one said sleeve member of said tip to limit movement and resist removal of said tip relative to said shell in one direction; and a cover releasably attached to said shell, said cover indicative of said tip being positioned in said closed position when said cover is attached to said shell.

10. A container closure comprising:

a shell having a body attachable to a container around a container opening thereof, said shell having a shell opening in fluid communication with the container opening when said shell is attached to the container, wherein said shell includes a central stem, said shell opening is an annular opening surrounding said stem, an annular wall extending from said body and surrounding said annular opening, wherein said stem is attached to said annular wall;

a tip received on said shell movable between a closed position sealing said shell opening and an open position, wherein said tip is slidably received on said shell and said tip includes two sleeve members, including an inner sleeve member positioned radially inwardly of said annular wall, an outer sleeve member positioned radially outwardly of said annular wall, at least one ring sealing member extending from one said sleeve member and in sliding engagement with said annular wall, and a grippable ledge extending radially outwardly from said outer sleeve member; and a cover releasably attached to said shell, said cover indicative of said tip being positioned in said closed position when said cover is attached to said shell.

11. A container closure comprising:

a shell having a body attachable to a container around a container opening thereof, said shell having a shell opening in fluid communication with the container opening when said shell is attached to the container, wherein said shell includes a central stem, said shell opening is an annular opening surrounding said stem, an annular wall extending from said body and surrounding said annular opening, wherein said stem is attached to said annular wall, wherein said shell further includes a means for attaching said shell to the container formed on said body, and a tamper-evident band extending from said body;

a tip received on said shell movable between a closed position sealing said shell opening and an open position; and a cover releasably attached to said shell, said cover indicative of said tip being positioned in said closed position when said cover is attached to said shell.

12. The container closure of claim 11 wherein said shell further includes a sealing ring attached to said body, said sealing ring sealing against the container around the container opening when said shell is attached to said container.

13. A container closure comprising:

a shell having a body attachable to a container around a container opening thereof, said shell having a shell opening in fluid communication with the container opening when said shell is attached to the container, wherein said shell includes a central stem, said shell opening is an annular opening surrounding said stem, an annular wall extending from said body and surrounding said annular opening, wherein said stem is attached to said annular wall, wherein said shell further includes a plurality of bridging elements extending across said annular opening between said stem and said annular wall to secure said stem to said annular wall;

a tip on said shell movable between a closed position sealing said shell opening and an open position; and a cover releasably attached to said shell, said cover indicative of said tip being positioned in said closed position when said cover is attached to said shell.

14. A container closure comprising a shell attachable to a container around a container opening thereof, said shell having a body, a central stem, an annular opening surrounding said stem and an annular wall surrounding said annular opening, said annular wall extending from said body and said stem attached to said annular wall, wherein said stem extends above said annular wall; and a tip slidably received on said stem, said tip including an opening and a stem-sealing member surrounding said opening, said tip movable between an open and closed position wherein said stem extends above said tip when said tip is in said closed position wherein said stem extends above said tip when said tip is in said closed position, wherein said tip includes an inner sleeve member positioned radially inwardly of said annular wall and an outer sleeve member positioned radially outwardly of said annular wall.

15. The container closure of claim 14 wherein said shell further includes an annular ring extending from said base and surrounding and spaced from said annular wall, and at least one projection extending radially outwardly on said annular ring.

16. The container closure of claim 14 wherein said stem includes a cover attaching means at a position above said tip when said tip is in said closed position.

17. The container closure of claim 14 wherein each said sleeve member includes a ring sealing member extending from said sleeve member and in sliding engagement with said annular wall.

18. The container closure of claim 17 wherein said tip includes a grippable ledge extending radially outwardly from said outer sleeve member.

19. A container closure comprising a one-piece shell attachable to a container around a container opening thereof, said shell having a body, a central stem having a cover attaching means, an annular opening surrounding said stem, an annular wall surrounding said annular opening, and an annular ring surrounding and spaced from said annular wall, said annular wall and said annular ring extending from said body and said stem attached to said annular wall, said annular ring including at least one projection extended radially outwardly of said annular ring and an undercut below said projection; and a tip for closing said annular opening, wherein said cover attaching means of said stem is above said tip when said tip closes said annular opening.

* * * * *

UNITED STATES PATENT AND TRADEMARK OFFICE

CERTIFICATE OF CORRECTION

PATENT NO. : 5,975,369

DATED : November 2, 1999

INVENTOR(S) : Michael A. Yurkewicz et al.

It is certified that error appears in the above-identified patent and that said Letters Patent is hereby corrected as shown below:

Column 7 Line 47-48, Claim 3, "said body said" should read --said body, said--.

Column 10 Lines 7-8, Claim 14, delete --wherein said stem extends above said tip when said tip is in said closed position--.

Signed and Sealed this

First Day of August, 2000

*Attest:*

Q. TODD DICKINSON

*Attesting Officer*

*Director of Patents and Trademarks*